United States Patent [19]

Minemura et al.

[11] Patent Number: 4,631,066

[45] Date of Patent: Dec. 23, 1986

[54] METHOD FOR IMPROVING LIGHT-RESISTANCE OF AROMATIC POLYAMIDE FIBERS

[75] Inventors: Norihiro Minemura; Fumiki Takabayashi, both of Takatsuki; Setsuo Yamada, Ibaraki, all of Japan

[73] Assignee: Teijin Limited, Osaka, Japan

[21] Appl. No.: 632,205

[22] Filed: Jul. 18, 1984

[30] Foreign Application Priority Data

Jul. 26, 1983 [JP] Japan ..... 58-135202
Mar. 30, 1984 [JP] Japan ..... 59-61122

[51] Int. Cl.[4] ..... D06M 13/28; D06M 13/34

[52] U.S. Cl. ..... 8/115.56; 8/195; 8/DIG. 21

[58] Field of Search ..... 8/115.56, 115.7, DIG. 4, 8/DIG. 18, DIG. 21, 120, 127.5, 127.6, 128 A, 128 R, 129, 189, 195; 524/112

[56] References Cited

U.S. PATENT DOCUMENTS 3,909,195 9/1975 Machell et al. ..... 8/115.7
3,929,408 12/1975 Ravet et al. ..... 8/585

*Primary Examiner*—Paul Lieberman
*Assistant Examiner*—John F. McNally
*Attorney, Agent, or Firm*—Burgess, Ryan & Wayne

[57] ABSTRACT

The light-resistance of aromatic polyamide fibers can be improved by heat-treating the aromatic polyamide fibers in the presence of urea and thiourea. The improvement in the light-resistance is enhanced by using aromatic polyamide fibers having an ultraviolet absorber incorporated therein.

10 Claims, No Drawings

METHOD FOR IMPROVING LIGHT-RESISTANCE OF AROMATIC POLYAMIDE FIBERS

BACKGROUND OF THE INVENTION (1) Field of the Invention

The present invention relates to a method for improving the light-resistance of aromatic polyamide fibers. More particularly, it relates to a method for improving the light-resistance of aromatic polyamide fibers useful in the textile field where a high light-resistance is required.

(2) Description of the Prior Art

It is known that aromatic polyamides are advantageously used in various fields. Aromatic polyamides have higher softening and melting points than those of aliphatic polyamides such as nylon-6 and nylon-6.6 and are excellent in heat-resistance characteristics such as the strength retention ratio and dimensional stability at high temperatures and the resistance to thermal decomposition, flame retardance, fire retardance, the chemical resistance, electric characteristics, and mechanical properties such as the tenacity and Young's modulus. Since aromatic polyamides have very desirable physical and chemical properties as mentioned above, they are especially suitably used for the production of heat-resistant fibers, flame-retardant fibers and fire-proofing fibers and high-tenacity, high-Young's modulus fibers and films. For example, aromatic polyamides are widely used as electrically insulating materials for motors or transformers, as industrial materials for production of filter bags and heating pipes and as textile materials for woven fabrics for which an aesthetic effect is not particularly required. In the field of textile fibers where fashionable colors are considered important, aromatic polyamides are used for heat-resistant safety clothes such as aircraft jackets and fire jackets. Moreover, blended yarns and mixed woven and knitted fabrics of aromatic polyamide fibers with rayon, cotton or wool, exhibit sweat-absorbing, moisture-absorbing and heat-insulating properties in addition to the above-mentioned excellent characteristics of aromatic polyamides, and are now used for sports wears and comfortable wears that can be worn under a heavy duty. With recent increase of utilization of aromatic polyamides in the textile field, the problem of a poor light-resistance of poor light fastness has become serious.

As means for improving the light-resistance of aromatic polyamide fibers, there has been disclosed a method in which an ultraviolet absorbent is incorporated at the dyeing step. However, since aromatic polyamide fibers are essentially difficult to dye, the dispersion of the ultraviolet absorbent within the fibers is low, and no satisfactory results can be obtained according to this method. Moreover, even if a carrier is used as an absorption promoter, the ultraviolet absorbent is not sufficiently introduced into the fibers, and hence, no substantial effect of improving the light-resistance can be obtained.

SUMMARY OF THE INVENTION

It is therefore a primary object of the present invention to provide aromatic polyamide fibers and fabrics having an excellent light-resistance while retaining excellent characteristics of aromatic polyamides as much as possible.

More specifically, in accordance with the present invention, there is provided a method for improving the light-resistance of aromatic polyamide fibers, which comprises heat-treating aromatic polyamide fibers in the presence of urea and thiourea.

DETAILED DESCRIPTION OF THE PREFERRED EMBODIMENTS

The aromatic polyamides fibers used in the present invention are fibers of an aromatic polyamide comprised of recurring units represented by the following general formula:

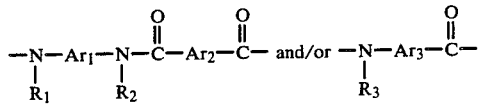

In the above general formula, $R_1$, $R_2$ and $R_3$, which may be the same or different, stand for a hydrogen atom or an alkyl group having up to 5 carbon atoms, such as a methyl group, an ethyl group, a propyl group, a butyl group or a pentyl group. A hydrogen atom is most preferred.

$Ar_1$, $Ar_2$ and $Ar_3$, which may be the same or different, stand for a member selected from groups represented by the formulae:

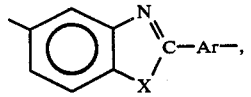

(1)

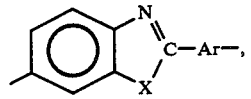

(2)

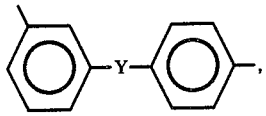

(3)

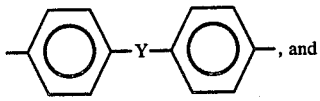

(4)

—Ar'—. (5)

In the general formulae (1) and (2), X is a group selected from —O—, —S— and

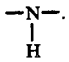

It is preferred that X be —O— or

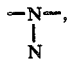

more preferably —O—. In the general formulae (3) and (4), Y is a group selected from —O—, —S—, —$SO_2$—, —$CH_2$—,

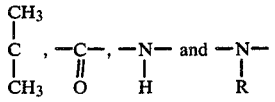

(R stands for an alkyl group having up to 5 carbon atoms). It is preferred that Y be —O—, —S— or

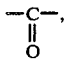

more preferably —O—.

In the general formulae (1), (2) and (5), Ar and Ar', which may be the same or different, are selected from coaxially and parallel oriented aromatic rings. As the coaxially and parallel oriented aromatic rings, there can be mentioned, for example, a 1,4-phenylene group, a 1,3-phenylene group, a 4,4'-biphenylene group, a 1,5-naphthylene group, a 2,6-naphthylene group and a 2,5-pyridylene group. Among them, 1,4-phenylene and 1,3-phenylene groups are preferred.

Aromatic polyamides preferably used in the present invention include a polyamide comprising

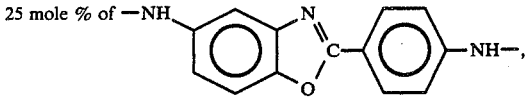

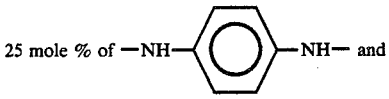

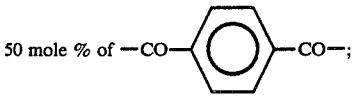

a polyamide comprising

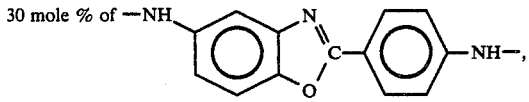

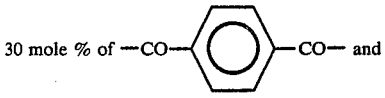

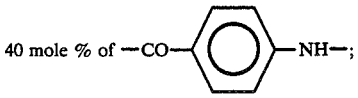

a polyamide comprising

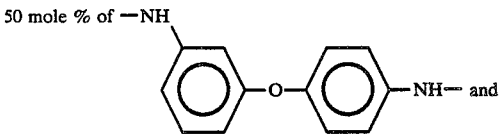

-continued

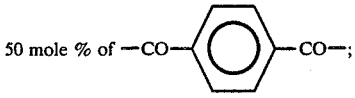

a polyamide comprising

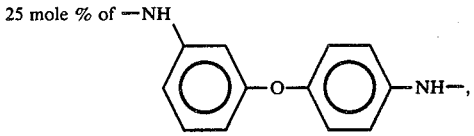

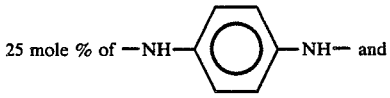

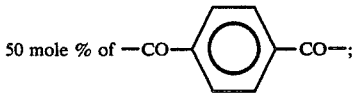

a polyamide comprising

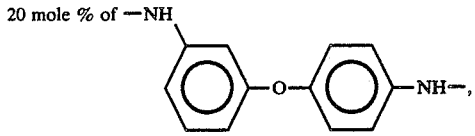

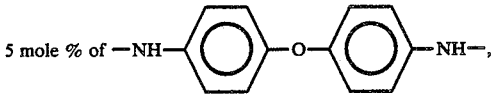

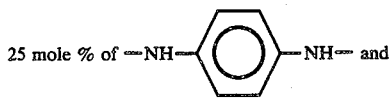

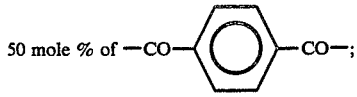

a polyamide comprising

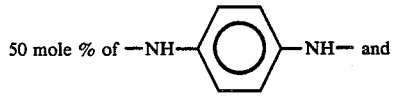

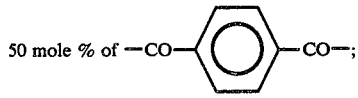

a polyamide comprising

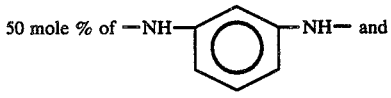

-continued 50 mole % of 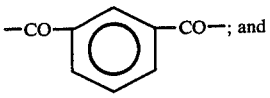 ; and a polyamide comprising 40 mole % of 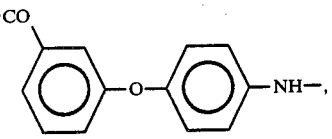 , 30 mole % of 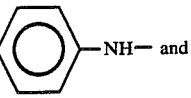 and 30 mole % of 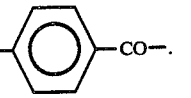 .

The benzene rings in the skeletons (1) through (5) and the above-mentioned aromatic ring residues may have substituents such as halogen atoms (for example, chloride, bromine and fluorine atoms), lower alkyl groups (for example, methyl ethyl, isopropyl and n-propyl groups), lower alkoxy groups (methoxy and ethoxy groups), an cyano, acetyl and nitro groups.

The intended effect of improving the light-resistance can be attained only when aromatic polyamide fibers are heat-treated in the present of urea and thiourea. If the heat treatment is carried out in the presence of urea or thiourea alone, the intended effect cannot be attained.

It has been confirmed that if an ultraviolet absorber-incorporated aromatic polyamide is used, the effect of the improving the light-resistance is further enhanced. Moreover, in this case, by the ultraviolet absorber, the reduction of the strength under irradiation is moderated, that is, the strength retention ratio is increased.

As the ultraviolet absorber there can be used (1) phenylbenzotriazoles of the following formula:

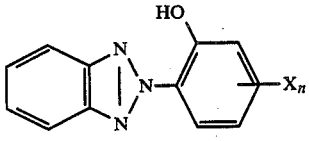

and (2) 2,2'-dihydroxybenzophenones of the following formula:

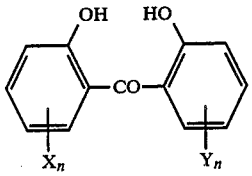

wherein X and Y, which may be the same or different, stand for a hydrogen or halogen atom or an alkyl or alkoxy group having 1 to 5 carbon atoms, and n is an integer of from 1 to 4.

These compounds have a good affinity with aromatic polyamides and a good miscibility therewith, and they show a high absorbing property to rays having a wavelength of 340 to 410 mμ. As examples of the compounds (1) and (2), there can be mentioned 2-(2'-hydroxy-5'-methylphenyl)benzotriazole, 2-(2'-hydroxy-3'-chloro-5'-methylphenyl)benzotriazole, 2-(2'-hydroxy-3'-chloro-5'-t-butylphenyl)benzotriazole, 2,2'-dihydroxy-4,4'-dimethoxybenzophenone, 2,2'-dihydroxy-4-methoxy-benzophenone and 2,2'-dihydroxy-4,4'-dibenzyloxybenzophenone. Among these compounds, 2-(2'-hydroxy-5'-methylphenyl)benzotriazole and 2,2'-dihydroxy-4,4'-dimethoxybenzophenone are especially preferred.

The ultraviolet absorber may be included into aromatic polyamide fibers at the polymerization step of forming an aromatic polyamide or the ultraviolet absorbent may be added to a solution of an aromatic polyamide (an aromatic polyamide dope). It is preferred that the ultraviolet absorber be added in an amount of 1 to 15% by weight, more preferably 3 to 12% by weight, based on the aromatic polyamide. If the amount of the ultraviolet absorber added is smaller than 1% by weight, the effect of improving the light-resistance is hardly obtained. If the amount of the ultraviolet absorber added is larger than 15% by weight, the flame retardancy is degraded.

Methods for including urea and thiourea into aromatic polyamide fibers will now be described.

In the case where a mixture of urea and thiourea is applied to an aromatic polyamide fabric, good results are obtained by applying the mixture in the form of either a powder or a solution, but when a solution of the mixture is applied in the form of a solution, the fabric is padded with the solution and squeezed by a mangle or the like, or the solution is sprayed to the fabric and the fabric is then dried.

When the mixture is applied in the form of a solution, the concentration of the mixture of urea and thiourea may be 1 to 100% by weight, but it is ordinarily preferred that the concentration of the mixture be 20 to 80% by weight. Good results are obtained when the mixing weight ratio of urea to thiourea is in the range of 80/20 to 20/80, and especially prominent effects are obtained when the mixing weight ratio of urea to thiourea is in the range of from 70/30 to 50/50. It is preferred that the pH value of the solution is in the range of from 3 to 10. If the pH value of the solution is smaller than 3 or larger than 10, undesirable decomposition of urea or thiourea takes place. The drying temperature may be in the range of from 80° to 130° C.

Then, the heat treatment, namely, curing is carried out. The curing treatment is carried out at 160° to 210° C., preferably 180° to 190° C., for a treatment time of 30 seconds to 5 minutes, preferably 1 to 2 minutes. Under milder conditions, the effect of improving the light-resistance is low, and under severer conditions, aromatic polyamide fibers are browned and the touch is hardened, with the result that the treated fibers cannot be put into practical use.

It is preferred that the amount of the mixture of urea and thiourea deposited is 0.2 to 2.0 g per g of the fiber before curing and 0.1 to 1.0 g per g of the fiber after curing.

When the heat treatment (curing) is carried out in the state where the aromatic polyamide fabric containing the mixture of urea and thiourea is packed and sealed with a heat-resistance film, the light-resistance is further enhanced. A heat-resistant synthetic resin film or a metal foil or film may be used as the heat-resistant film. It is preferred that the heat-resistant film be contacted with the fabric as tightly as possible to reduce the space within the pack, and it is especially preferred that oxygen within the pack be replaced by an inert gas or the aromatic polyamide fabric containing the mixture of urea and thiourea be vacuum-packed.

The aromatic polyamide used in the present invention may be a copolyamide with an aromatic polyamide having a functional group having an affinity with a dye in the molecule chain. If an aromatic copolyamide having a dyeability improved by such a third component, the effect of the present invention is especially prominent. It is considered that the reason is that inactivation of amino groups is effectively performed in the interior of the fibers.

The aromatic polyamide fibers to be treated according to the present invention may be undyed fibers (scoured and set fibers) or fibers dyed with an ionic dye such as an acid dye or cationic dye or a nonionic dye such as a disperse dye or threne dye. Moreover, fibers containing a pigment may be treated. Furthermore, the present invention can be applied to not only fibrous structures composed solely of aromatic polyamide fibers but also fibrous structures composed mainly of aromatic polyamide fibers, such as blended yarn fabrics, mixed knitted fabrics and mixed woven fabrics of aromatic polyamide fibers with other synthetic fibers such as polyester, aliphatic polyamide and polyvinyl chloride fibers, natural fibers such as cotton and wool, or semi-synthetic fibers such as rayon.

The present invention will now be described in detail with reference to the following examples that by no means limit the scope of the invention.

In the examples, all of "%" and "parts" are by weight, unless otherwise indicated.

The light-resistance was determined by a fadeometer, and after 40 hours' irradiation, the light-resistance was evaluated according to the 5-stage method where the case of no discoloration was evaluated as class 5 (best) and the case of extreme discoloration was evaluated as class 1 (worst).

EXAMPLES 1 THROUGH 6 AND COMPARATIVE EXAMPLES 1 THROUGH 3

A plain weave fabric (spun yarn of 30-count doubled yarns, basis weight of 200 g/m$^2$) composed of poly-m-phenylene-isophthalamide fibers (TEIJINCONEX supplied by Teijin Limited) was padded with an aqeuous solution containing 30% of a mixture comprising urea and thiourea at a weight ratio shown in Table 1, and the fabric was squeezed at a pick-up ratio of 80% by a mangle, dried at 100° C. for 4 minutes and cured at 190° C. for 1 minute. The light-resistance of the treated fabric was measured. The obtained results are shown in Table 1.

For comparison, the above treatment was carried out in the same manner except that water alone (Comparative Example 1), an aqueous solution containing urea alone (Comparative Example 2) or an aqueous solution containing thiourea alone (Comparative Example 3) was used instead of the aqueous solution of the mixture of urea and thiourea.

The pH value of the treating solution was adjusted to 6.5 in Example 1 through 6, 7.0 in Comparative Example 1 and 2 to 3 in Comparative Examples 2 and 3.

TABLE 1

| | Mixing Weight Ratio in Treating Solution | | Light-resistance (class) |
|---|---|---|---|
| | Thiourea (parts) | Urea (parts) | |
| Example 1 | 20 | 80 | 2.5 |
| Example 2 | 30 | 70 | 3.0 |
| Example 3 | 40 | 60 | 3.5 |
| Example 4 | 50 | 50 | 3.0 |
| Example 5 | 60 | 40 | 2.5 |
| Example 6 | 70 | 30 | 2.0 |
| Comparative Example 1 | 0 | 0 | <1 |
| Comparative Example 2 | 0 | 100 | 1.5 |
| Comparative Example 3 | 100 | 0 | 1.5 |

The test was repeated in the same manner as in Example 3 except that the pH value of the aqueous solution of the mixture of urea and thiourea was changed to 5 or 9. When the pH value was adjusted to 5, acetic acid was used, and sodium carbonate was used for adjusting the pH value to 9. In each case, the light-resistance of the treated fabric was class 3.5 and as good as in Example 3.

EXAMPLE 7 AND COMPARATIVE EXAMPLE 4

Doubled yarn (1500/2) of aromatic poly(3,4'-diphenylether-terephthalamide) copolymer fibers consisting of recurring units represented by the following formulae:

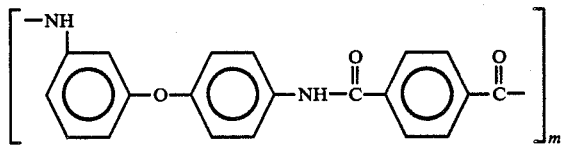

and

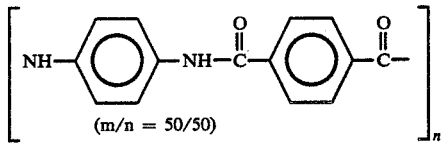

and having a fineness of 1500de/1000f, a strength of 26 g/d, an elongation of 4.5% and an initial Young's modulus of 600 g/d was S-twisted at 10 T/cm. The twisted yarn was padded with an aqueous solution containing 30% of a mixture comprising 60 parts of urea and 40 parts of thiourea, squeezed at a pick-up ratio of 80% by a mangle, dried at 100° C. for 4 minutes and then cured at 190° C. for 1 minute. The light-resistance of the treated yarn is shown in Table 2. For comparison, the twisted yarn was treated in the same manner as described above except that water alone was used as the treating solution. The light-resistance of the obtained yarn is shown in Table 2.

The pH value was adjusted to 6.5 in Example 7 and 7.0 in Comparative Example 4.

TABLE 2

| | Composition of Treating Solution | Light-resistance |
|---|---|---|
| Example 7 | 60 parts of urea and 40 parts of thiourea | class 3 |
| Comparative Example 4 | water alone | below class 1 |

EXAMPLES 8 AND COMPARATIVE EXAMPLE 5

KEVLAR (supplied by Du Pont Co.; 291,500 de) was treated in the same manner as in Example 2, and the light-resistance was measured to obtain a result shown in Table 3. For comparison, the above procedures were repeated in the same manner except that water alone was used as the treating solution. The obtained light-resistance is shown in Table 3.

TABLE 3

| | Composition and pH Value of Treating Solution | Light-resistance |
|---|---|---|
| Example 8 | 60 parts of urea and 40 parts of thiourea, pH value of 6.5 | class 3 |
| Comparative Example 5 | 100% of water, pH value of 7.0 | below class 1 |

EXAMPLE 9

The same fabric as used in Example 1 was padded with an aqueous solution containing 20 or 30% of a mixture comprising 40 parts of urea and 60 parts of thiourea, squeezed at a pick-up ratio of 80% by a mangle, dried at 100° C. for 4 minutes, sealed in an aluminum foil and then cured at 190° C. for 1 minute. In each case, the light-resistance of the treated fabric was class 4.

EXAMPLES 10 AND 11 AND COMPARATIVE EXAMPLE 6

40-Count doubled yarn of polymethaphenylene-isophthalamide staple fibers (TEIJINCONEX supplied by Teijin Limited) mixed with 5% of Tinuvin 326 (ultraviolet absorber supplied by Ciba-Geigy) was padded with an aqueous solution containing 30% of a mixture comprising urea and thiourea at a weight ratio of 60/40 and having a pH value of 6.5, squeezed at a pick-up ratio of 80% by a mangle, dried at 100° C. for 4 minutes and then cured at 180° C. for 1 minute. The light-resistance of the treated yarn was found to be class 4.5 (Example 10).

When polymethaphenylene-isophthalamide staple fibers free of Tinuvin were treated in the same manner as described above, the light-resistance was found to be class 3.5 (Example 11).

When padding was carried out by using water (pH=7.0) alone instead of the aqueous solution of the mixture of urea and thiourea, the light-resistance was found to be below class 1 (Comparative Example 6).

In each case, the strength and elongation were measured by a Tensilon tester before and after the determination of the light-resistance (40 hours' irradiation), and the strength retention ratio was calculated. The obtained results are shown in Table 4.

TABLE 4

| | Composition of Treating Solution | Before Irradiation | | After Irradiation | | Strength Retention Ratio (%) |
|---|---|---|---|---|---|---|
| | | Strength (g) | Elongation (%) | Strength (g) | Elongation (%) | |
| Example 10 | 60 parts of urea and 40 parts of thiourea | 260.0 | 44.1 | 255.4 | 39.0 | 98 |
| Example 11 | 60 parts of urea and 40 parts of thiourea | 262.5 | 45.2 | 238.8 | 36.6 | 91 |
| Comparative Example 6 | 100% of water | 265.2 | 47.1 | 156.4 | 10.5 | 59 |

EXAMPLES 13 THROUGH 18 AND COMPARATIVE EXAMPLES 7 THROUGH 9

A plain weave fabric (spun yarn of 30-count doubled yarns, basis weight of 200 g/m$^2$) of polymethaphenylene-isophthalamide fibers (TEIJINCONEX supplied by Teijin Limited) containing Tinuvin 326 in an amount of 10% based on the polymer was padded with an aqueous solution containing 30% of a mixture comprising urea and thiourea at a weight ratio shown in Table 5 and having a pH value of 6.5, squeezed at a pick-up ratio of 80% by a mangle, dried at 100° C. for 4 minutes and then cured at 190° C. for 4 minutes. The light-resistance of the treated fabric was measured. The obtained results are shown in Table 5.

For comparison, the above procedures were repeated in the same manner as described above except that water (pH=7.0) alone was used as the treating solution (Comparative Example 7), an aqueous solution (pH=7.0) containing urea alone was used (Comparative Example 8) or an aqueous solution (pH=7.0) containing thiourea alone was used (Comparative Example 9).

TABLE 5

| | Composition of Treating Solution | | | Light-resistance (class) |
|---|---|---|---|---|
| | Thiourea (parts) | Urea (parts) | pH | |
| Example 13 | 20 | 80 | 6.5 | 3.5 |
| Example 14 | 30 | 70 | 6.5 | 4.0 |
| Example 15 | 40 | 60 | 6.5 | 4.5 |
| Example 16 | 50 | 50 | 6.5 | 4.0 |
| Example 17 | 60 | 40 | 6.5 | 3.5 |
| Example 18 | 70 | 30 | 6.5 | 3.0 |
| Comparative Example 7 | 0 | 0 | 7.0 | <1 |
| Comparative Example 8 | 0 | 100 | 6.5 | 2.0 |
| Comparative Example 9 | 100 | 0 | 6.5 | 2.0 |

EXAMPLE 19 AND COMPARATIVE EXAMPLE 10

Doubled yarn (1500/2) of aromatic poly(3,4'-diphenylether-terephthalamide copolymer fibers consisting of recurring units represented by the following formulae:

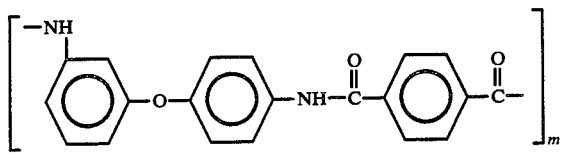

and

-continued

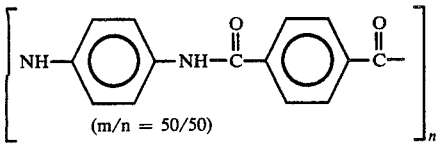

(m/n = 50/50)

and having a fineness of 1500de/1000f, a strength of 26 g/d, an elongation of 4.5% and an initial Young's modulus of 600 g/d, in which Tinuvin 326 was incorporated in an amount of 5%, was S-twisted at 10 T/cm. The twisted yarn was padded with an aqueous solution containing 30% of a mixture comprising 60 parts of urea and 40 parts of thiourea and having a pH value of 6.5, squeezed at a pick-up ratio of 80% by a mangle, dried at 100° C. for 4 minutes and then cured at 190° C. for 1 minute. The photoresistance of the treated yarn is shown in Table 6. For comparison, the twisted yarn was treated in the same manner as decribed above except that water (ph=7.0) alone was used as the treating solution. The light-resistance of the obtained yarn is shown in Table 6.

TABLE 6

| | Composition of Treating Solution | pH | Light-resistance |
|---|---|---|---|
| Example 19 | 60 parts of urea and 40 parts of thiourea | 6.5 | class 4 |
| Comparative Example 10 | Water alone | 7.0 | below class 1 |

We claim:

1. A method for improving the light-resistance of aromatic polyamide fibers, which comprises the steps of heat-treating aromatic polyamide fibers while in contact with a mixture of urea and thiourea in the range 80:20 to 20:80.

2. A method according to claim 1, wherein the aromatic polyamide fibers are fibers of an aromatic polyamide comprised of recurring units represented by the following general formula:

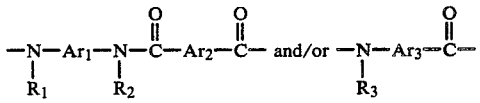

wherein $R_1$, $R_2$ and $R_3$, which may be the same or different, stand for a hydrogen atom of an alkyl group having up to 5 carbon atoms, and $Ar_1$, $Ar_2$ and $Ar_3$, which may be the same or different, stand for a member selected from groups represented by the formulae:

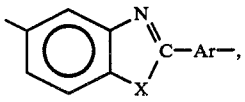

(1)

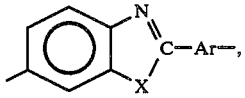

(2)

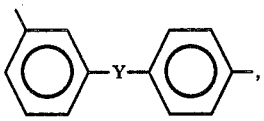

(3)

-continued

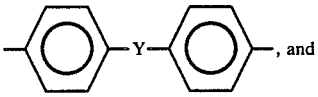

(4)

—Ar'—. (5)

in the general formulae (1) and (2), X being a group selected from the group consisting of —O—, —S— and —NH—, and Y being a group selected from the group consisting of —O—, —S—, —$SO_2$—, —$CH_2$—,

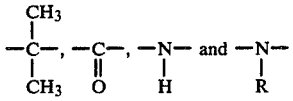

(R stands for an alkyl group having up to 5 carbon atoms).

3. A method according to claim 1, wherein the aromatic polyamide fibers contains 1 to 15% by weight, based on the weight of the fibers, of an ultraviolet absorber.

4. A method according to claim 3, wherein the ultraviolet absorber is selected from the group consisting of:

(1) phenylbenzotriazoles of the following formula:

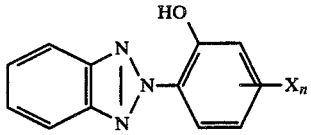

and (2) 2,2'-dihydroxybenzophenones of the following formula:

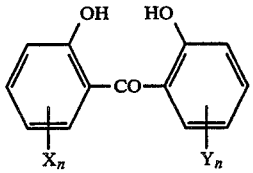

wherein X and Y, which may be the same or different, stand for a hydrogen or halogen atom or an alkyl or alkoxy group having 1 to 5 carbon atoms, and n is an integer of from 1 to 4.

5. A method according to claim 1, wherein a mixture of urea and thiourea is applied to the aromatic polyamide fibers before the heat-treatment.

6. A method according to claim 5, wherein the proportion of urea to thiourea in the mixture is in the range of from 70:30 to 50:50 by weight.

7. A method according to claim 5, wherein the mixture of urea and thiourea is applied in the form of a solution containing 20 to 80% by weight of the mixture and having a pH value of 3 to 9.

8. A method according to claim 1, wherein the aromatic polyamide fibers are heat-treated at a temperature of 180° to 190° C. for a period of one to two minutes.

9. A method according to claim 1, wherein the aromatic polyamide fibers are heat-treated in the state where the fibers are packed and sealed with a heat-resistant film.

10. A method according to claim 1, wherein the aromatic polyamide fibers are heat-treated at a temperature of 160° to 210° C. for a period of 30 seconds to 5 minutes.

* * * * *